US005337923A

United States Patent [19]

Lugez et al.

[11] Patent Number: 5,337,923

[45] Date of Patent: Aug. 16, 1994

[54] FLEXIBLE, INWARDLY FOLDABLE CONTAINER FOR A LIQUID OR A PASTE TO BE DISPENSED WITHOUT INGRESS OF AIR, AND A METHOD OF MANUFACTURE

[75] Inventors: Pierre Lugez, Sainte-Colombe-La-Commanderie; Claude Jouillat, Montigny-Sur-Avre; Michel Brunet, Sainte-Colombe-La-Commanderie, all of France

[73] Assignee: Valois (société anonvme), Le Neubourg, France

[21] Appl. No.: 720,994

[22] Filed: Jun. 26, 1991

[30] Foreign Application Priority Data

Jun. 27, 1990 [FR] France ..... 90 08088

[51] Int. Cl.[5] ..... B65D 35/56; B67D 5/00

[52] U.S. Cl. ..... 222/183; 222/105; 222/321; 264/523

[58] Field of Search ..... 222/95, 105, 107, 183, 222/386.5, 321; 220/403, 408, 410, 445; 264/523

[56] References Cited

U.S. PATENT DOCUMENTS

| | | | |
|---|---|---|---|
| 1,927,553 | 9/1933 | Lusher | 222/183 |
| 2,700,578 | 1/1955 | Efford | 222/183 X |
| 3,118,572 | 1/1964 | Harding . | |
| 3,257,025 | 6/1966 | Jolly | 222/183 X |
| 3,310,830 | 3/1967 | Gattone | 222/183 X |
| 3,420,413 | 1/1969 | Corsette | 222/107 |
| 3,926,341 | 12/1975 | Lhoest | 222/107 |
| 4,213,933 | 7/1980 | Cambio . | |
| 5,004,123 | 4/1991 | Stoody | 222/105 |
| 5,083,678 | 1/1992 | Waring | 222/105 X |
| 5,156,299 | 10/1992 | De Caluwe et al. | 222/105 X |
| 5,174,458 | 12/1992 | Segati | 222/107 X |

FOREIGN PATENT DOCUMENTS

| | | | |
|---|---|---|---|
| 0144925 | 3/1985 | European Pat. Off. . | |
| 1670 | of 1883 | United Kingdom | 222/183 |
| 294187 | 6/1928 | United Kingdom . | |

*Primary Examiner*—Kevin P. Shaver
*Attorney, Agent, or Firm*—Sughrue, Mion, Zinn, Macpeak and Seas

[57] ABSTRACT

A device for containing a liquid or a paste for dispensing without ingress of air comprises a flexible container containing the substance to be dispensed and a carrier 20. The container is inserted inside the carrier, and the container is constituted by a peripheral side wall 4 extending between a bottom 3 and a top having a bottleneck 2 opening out therethrough. The carrier provided with at least two facing longitudinal ribs 21, the ribs constraining the side wall, the bottom, and the top of the container to fold concertina-like.

9 Claims, 4 Drawing Sheets

FLEXIBLE, INWARDLY FOLDABLE CONTAINER FOR A LIQUID OR A PASTE TO BE DISPENSED WITHOUT INGRESS OF AIR, AND A METHOD OF MANUFACTURE

The present invention relates to a device designed to contain a liquid or a paste to be dispensed without ingress of air, and to a method of manufacturing the device.

BACKGROUND OF THE INVENTION

The liquid or paste in question may be a food product, a hygiene product, a cosmetic, or any other substance that must be stored without coming into contact with air. Such a substance may be dispensed, with or without being sprayed, by means of a manual pump or some other device that prevents air penetrating into a receptacle containing the substance to be dispensed. The receptacle must therefore be deformable so that its inside volume is always equal to the volume of substance that remains to be dispensed.

Numerous deformable receptacles are known in the state of the art. For example, French patent application No. 89 06947 in the name of Valois describes a metering dispenser for liquid or paste that operates without ingress of air and in which the substance to be dispensed is contained in a flexible bag, e.g. made of elastomer, and itself contained in a rigid container having a dispenser device such as a manually-actuated pump fixed thereon.

A problem that may arise with any flexible bag is that it may become kinked as is deforms and its wall may thus obstruct the outlet orifice before all of the substance contained in the bag has been consumed.

An object of the present invention is to avoid this drawback.

SUMMARY OF THE INVENTION

The present invention thus provides a device for containing a liquid or a paste for dispensing without ingress of air, the device comprising a flexible container containing the substance to be dispensed and a container carrier, said container being inserted inside the carrier, and said container being constituted by a peripheral side wall extending between a bottom and a top having a bottleneck opening out therethrough, wherein said carrier is provided with at least two facing longitudinal ribs, said ribs constraining the side wall, the bottom, and the top of the container to fold concertina-like.

Advantageously, the present invention may comprise such a device in which the side wall of the flexible container comprises six faces connected to one another by edges, with two substantially parallel opposite first faces being of greater width than the other faces, the two first faces being of substantially identical width, and the four narrower other faces being of substantially the same, different width and being divided into two pairs each extending between the two first faces, each pair of narrower faces extending via a first swelling to the top of the container and via a second swelling to the bottom of the container, the edges and the swellings being thinner than the other parts of the container and therefore more flexible, such that the ribs of the carrier are capable of causing the narrower faces to fold towards the inside of the container when the container is inserted in the carrier, with the edges acting as hinges. As the substance contained in the container is consumed, the two larger faces move towards each other while remaining substantially parallel, whereas the narrower other faces continue to fold towards the inside of the container tending to become parallel to said larger faces, with the bottom and the top of the container continuing to fold except in the intermediate vicinity of the rigid bottleneck where the wider first faces continues to be held a certain distance apart from each other such that substantially all of the substance contained in the container may be dispensed without the walls of the container running the risk of closing the bottleneck prematurely.

Advantageously, the device may further include a dispensing pump, with the deformation of the container caused by the ribs when the container is inserted in the carrier raising the pressure of the substance to be dispensed sufficiently to urge said substance into the pump, thereby priming said pump.

In a particular embodiment of the invention, the carrier may include a bottom and a bottleneck for surrounding the bottleneck of the container, said carrier being separable longitudinally into two halves to enable the container to be placed inside. Optionally, the two halves of the carrier are fixed to each other by means of lips which overlie one another when the two halves of the carrier are assembled together, said lips being provided with snap-fastening means. The snap-fastening means may comprise grooves formed in the lip(s) of one of the halves of the carrier, and complementary ribs formed on the lip(s) of the other half of the carrier. Advantageously, the bottom of the carrier does not split into two halves, and is connected via a hinge to each of the halves of said carrier.

The present invention also provides a method of manufacturing the device of the invention in which container formation includes at least one inflation step of blowing compressed gas into an open-ended hollow preform raised to a temperature that is high enough for it to be deformable, said preform being disposed in a mold having the shape of the container to be made such that said preform expands until it take up the shape of the mold, wherein the portions of the preform corresponding to the edges and to the swellings of the final container are those portions that move furthest from their initial positions during the inflation step such that the edges and the swellings are the finished portions of the container and thus the most flexible portions.

BRIEF DESCRIPTION OF THE DRAWINGS

An embodiment of the invention is described by way of example with reference to the accompanying drawings, in which.

DETAILED DESCRIPTION

Figure 3:
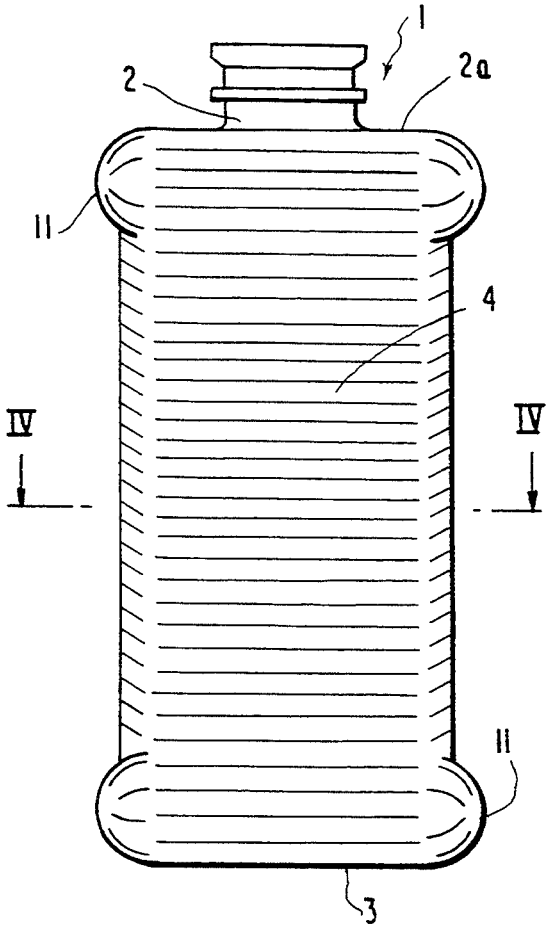
FIG. 3 is a side view of a container obtained using the preform of FIG. 1.
Figure 4:
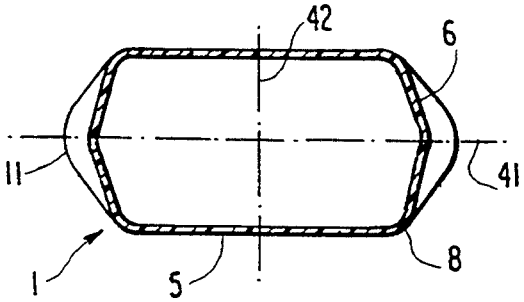
FIG. 4 is a plan view of the container of FIG. 3.

FIGS. 3 and 4 show one embodiment of a flexible container 1 used in a device of the invention. The container 1 comprises a bottom 3 from which there extends vertically upwards a peripheral side wall 4 which is extended at a top end by a horizontal top wall 2*a* which narrows down to a bottleneck 2 situated substantially in the middle of said wall 2*a*. The container 1 has two perpendicular vertical planes of symmetry referenced 41 and 42 in FIG. 4.

The side wall 4 comprises six faces, for example, including two opposite faces 5 that may be of greater width than the other faces 6. The two faces 5 are of the same width as each other, and all four faces 6 are likewise of the same, but different width. Continuous faces are joined together by edges 8 which may optionally be rounded. The faces 6 are divided into two pairs of contiguous faces. Each pair of contiguous faces 6 extends upwards via a first swelling or enlargement 11 to the top horizontal wall 2*a* and downwards via a second swelling 11 to the bottom 3.

The bottleneck 2 is advantageously more rigid than the remainder of the container 1. This result may be obtained by making the bottleneck 2 thicker than the remainder of the container 1. The container 1 may be made as a single piece of a single material having a degree of flexibility. Otherwise, the container 1 may comprise two pieces assembled together: the bottleneck may be an add-on piece made of polyethylene, for example, while the remainder of the container 1 maybe made of a more flexible material, e.g. a mixture of butyl rubber and of polyethylene as described in French patent application No. 90 00803.

In addition, the container 1 is made so that the edges 8 and the swellings 11 in the side wall 4 are thinner than the other zones of the wall 4 so as to be more flexible. The edges 8 are thus suitable for acting as hinges enabling the faces 6 to fold in towards the inside of the container 1. The swellings 11 may themselves extend inwards towards the inside of the container, like the fingers of gloves.

The container 1 is filled with the liquid or paste to be dispensed.

Figure 5:
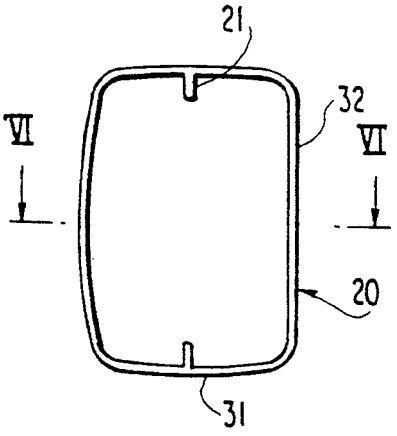
FIG. 5 is a plan view of an example of a carrier of the invention.
Figure 6:
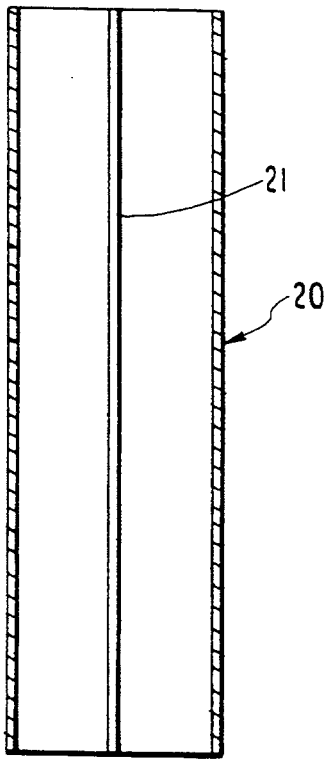
FIG. 6 is a section view on line VI—VI through the carrier of FIG. 5.

The container 1 is associated with a rigid container carrier or housing 20, one embodiment of which is shown in FIGS. 5 and 6. In this embodiment, the carrier 20 consists merely of a peripheral side wall having four faces and defining a duct. Advantageously, two facing faces 31 are narrower than the other two faces 32, with each of the narrower faces 31 having a longitudinally extending and inwardly projecting rib 21 running substantially along the middle of the width of said face. The dimensions of the carrier 20 are such as to enable the container 1 to be inserted therein.

Figure 7:
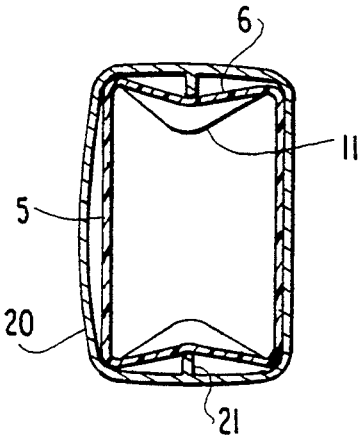
FIG. 7 is a plan view in section through the carrier of FIG. 6 containing the container of FIG. 3 while full of substance to be dispensed.

When the container 1 is inserted inside the carrier 20, as shown in FIG. 7, the flexible swellings 11 turn inside-out like fingers in a glove as they engage the ribs 21 and the faces 6 are pushed towards the inside of the container 1.

The container 1 is held inside the carrier 20 by any conventional means. The carrier 20 may be provided, for example, with a bottom wall. The device then has conventional dispensing means such as a manually or otherwise actuated pump mounted on the bottleneck 2 and communicating with the inside of the container 1. While the container 1 is being inserted in the can-cover 20, the deformation of the container 1 by the rib 21 increases the pressure of the substance contained inside the container 1, thereby ensuring that the substance penetrates into the pump and primes it.

Figure 8:
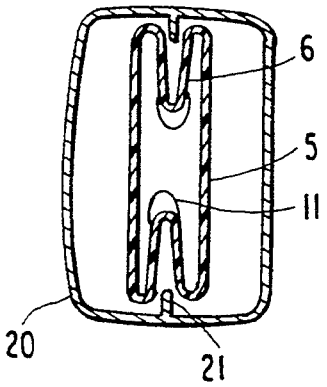
FIG. 8 is a view analogous to FIG. 7, but after some of the substance has been dispensed.

In this position, when the volume of substance contained inside the container 1 reduces, the two faces 5 move towards each other while the faces 6 fold further into the can 1 together with the swellings 11, and the bottom 3 and the top wall 2*a* also fold up. In this way, the container 1 deforms concertina-like as it empties, as shown in FIG. 8. Only a top portion of the container in the immediate vicinity of the rigid bottleneck 2 is prevented from folding onto itself, thereby holding the faces 5 away from the bottleneck and the pump mounted thereon.

This ensures that the container 1 deforms in regular manner up its entire height apart from the spacing imposed on the faces 5 in the immediate vicinity of the bottleneck 2. There is thus no danger of a portion of the wall 4 obstructing the neck 2 while the container is being emptied, thereby making it possible to dispense nearly all of the substance.

Other particular embodiments of the carrier 20 may be devised. For example, the carrier may be provided with a slot or a transparent portion enabling the user to see the can 1 which should then be transparent or translucent to give an idea on the quantity of substance remaining in the container.

Figure 10:
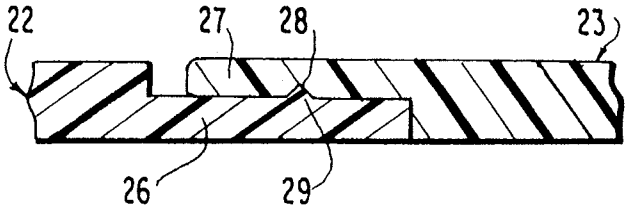
FIG. 10 is an enlargement of a portion of FIG. 9.
Figure 9:
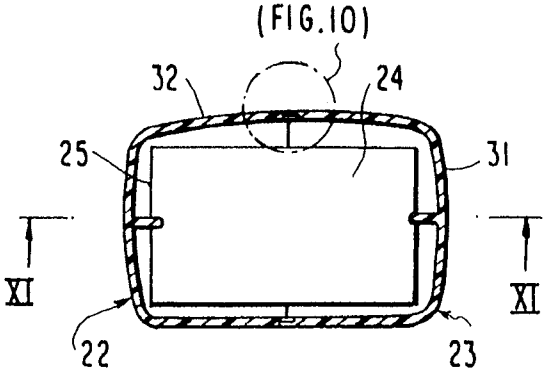
FIG. 9 is a plan view in section through a carrier that is separable into two halves.
Figure 11:
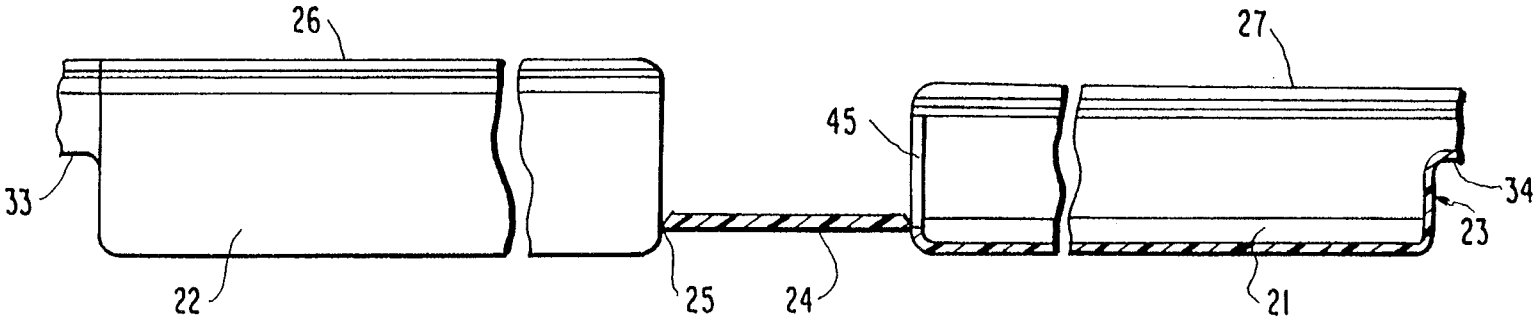
FIG. 11 is a fragmentary view in partial section on line XI—XI of the carrier of FIG. 9.

Alternatively, as shown in FIGS. 9 to 11, the side wall of the carrier 20 may split into two halves 22 and 23, with the split taking place substantially along the centers of the wider faces 32 of the side wall thereof. Each carrier half is thus substantially U-shaped in section. A snap-fastening lip 26, 27 projects from each half of the carrier 20 towards the other half thereof and may extend longitudinally over a certain distance along each longitudinal edge of said half of the carrier.

For example, the half 22 may have a lip 26 of substantially half the thickness of the wall extending along each of its longitudinal edges and extending the inside surface of the carrier. Each lip 26 may include a fine outwardly directed rib 29. The half 23 may include a complementary lip 27 extending along each of its longitudinal edges, having the same thickness as the lips 26 but extending the outside surface of the carrier, said lips 27 including respective grooves 28 facing the inside of the carrier for receiving the corresponding ribs 29 in snap-fastening relationship when the lips 27 are engaged over the lips 26, thereby assembling together the two halves of the carrier. Each half 22 or 23 terminates at a top end in the form of a respective half bottleneck 33 or 34 with these two half bottlenecks fitting round the bottleneck 2 of the container when the two halves of the carrier are assembled around a can 1. In addition, each half 22 or 23 may include a bottom end provided with a hinge 25 connecting said half to a bottom 24. The hinge 25 may be constituted merely by a thin region of material. The faces 32 of the side wall of the carrier are then provided around their bottom ends with inwardly directed flanges delimiting a recess 45 for receiving the bottom 24. The carrier 20 thus opens and closes by its two halves 22 and 23 rotating about hinges 25 which connect each of them to the bottom 24.

Figure 12:
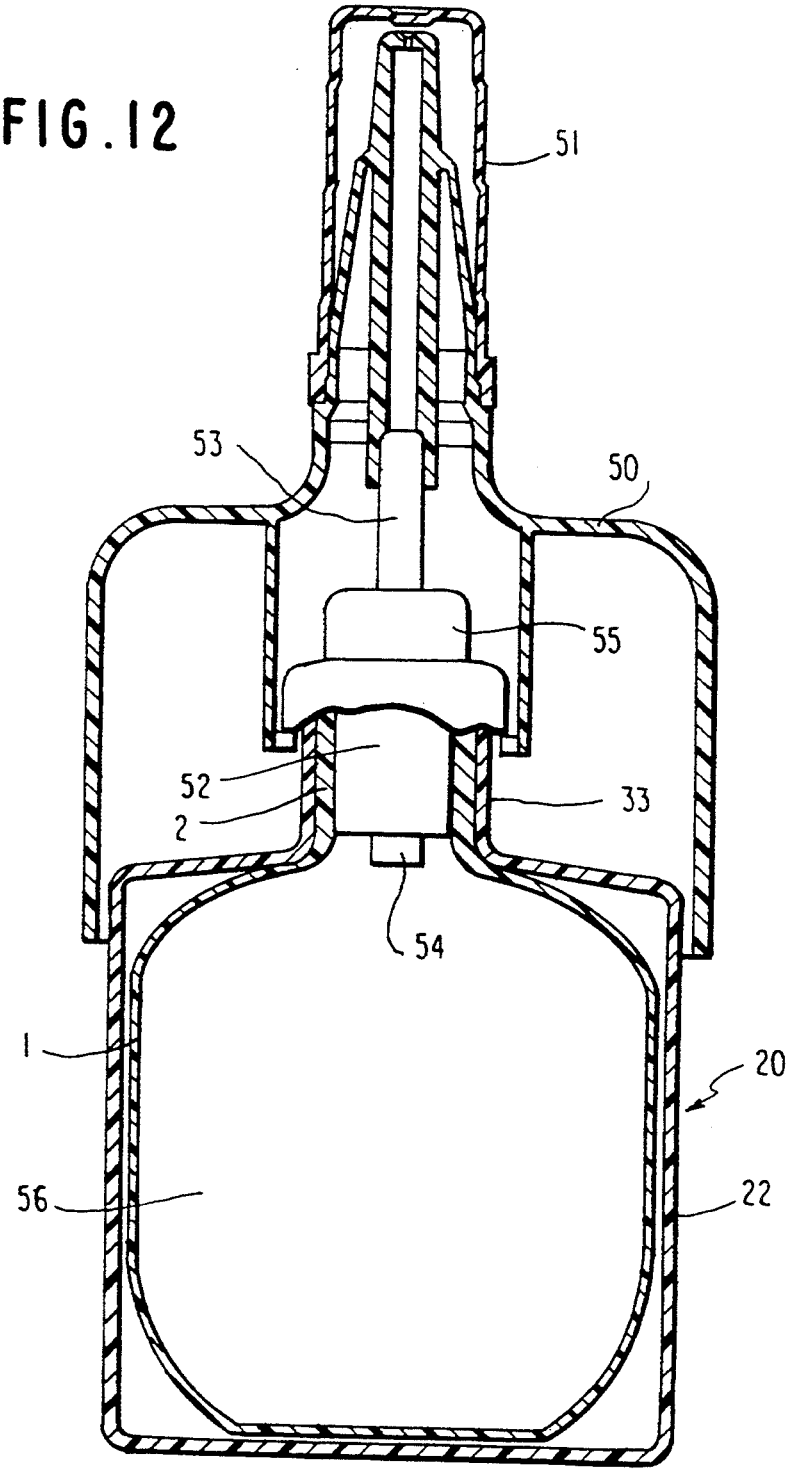
FIG. 12 is a section view through a device of the invention including a dispensing pump.

FIG. 12 is a section through a device of the invention comprising a carrier 20 separable into two halves 22 and 23 as described above and including a bottleneck 33, 34 which surrounds the bottleneck 2 of the container. The flexible container 1 defines an inside volume 56 which is filled with substance to be dispensed and then a pump 52 is mounted in the bottleneck 2 by any conventional means, e.g. by crimping a metal capsule 55 over the bottleneck 2 of the container and the bottleneck 33, 34 of the carrier. The metal capsule 55 thus locks together the two assembled halves 22 and 23 of the carrier 20. The pump 52 includes an inlet end 54 which is in communication with the inside volume 56 of the can 1, and a hollow sliding push rod 53 which serves both to actuate the pump 52 and to deliver the substance pumped out by the pump. The push red 53 is generally covered with an end fitting 50 which may itself be provided with a protective cap 51 which is installed outside periods of use.

Figure 1:
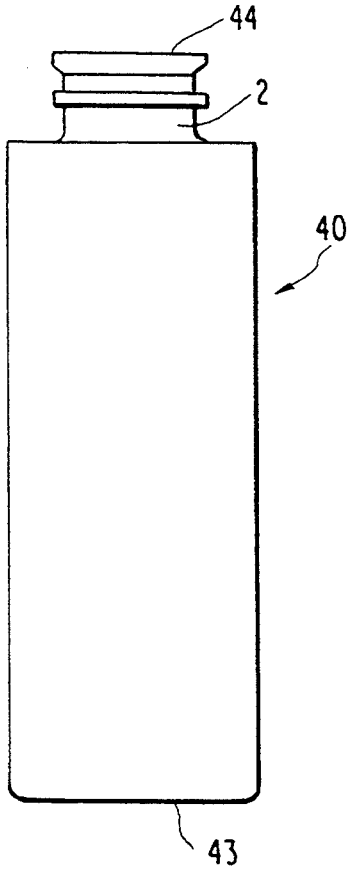
FIG. 1 is a side view of an example of a preform for a flexible container of the invention prior to being formed.
Figure 2:
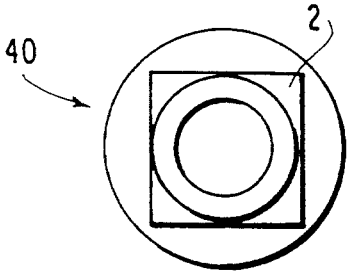
FIG. 2 is a plan view of the container preform of FIG. 1.

The various implementations of the carrier 20 may be conventionally formed by molding. Advantageously, the container 1 may he made by a blowing method, starting from a preform 40 as shown in FIGS. 1 and 2.

The preform 40 may be generally in the form of a hollow cylinder extending between a closed end 43 and an open end 44. The preform 40 may be made by any conventional method, e.g. by injection molding, in which case it is cylindrical on the inside up its entire height. The preform 40 may be formed as a single piece or it may include an add-on bottleneck 2 which may then be made of a material which is stiffer. The bottleneck 2 may optionally be narrower than the remainder of the preform 40. The open end 44 of the preform 40 may be given any desired outside shape, e.g. it may have a screw thread or one or more collars.

After optional heating, the preform 40 is inserted in a mold having the shape of the container 1 to be formed.

The preform 40 may also be formed on being inserted in the mold by using a blow-extrusion method: in which case a tube of molden plastic material is extruded and then one end of the tube is pinched by a portion of the mold so as to close it by welding. As before, the preform 40 then extends from an open end 44 to a closed end 43.

Regardless of the way in which the preform 40 is formed, when the preform 40 is in a mold and at a temperature such as to ensure that it is malleable, a gas under pressure and possibly hot is inserted into the perform 40 via its open end. This has the effect of expanding the preform until it adopts the inside shape of the mold, thereby taking up the shape of the container 1. During this operation, the wall of the container 1 becomes thinner by an amount related to the extent to which blowing moves the wall away from its initial position. Since the edges 8 and the swellings 11 are the portions of the container 1 that are furthest from the initial position of the preform 40, these are the thinnest portions of the container 1 and therefore the most flexible portions.

It is claimed:

1. A device for containing a liquid or a paste for dispensing without ingress of air, the device comprising: a flexible container containing the substance to be dispensed, and a container carrier, said container being inserted inside the carrier, and said container being made of a flexible plastic material and being constituted by a peripheral side wall extending between a bottom and a top having a bottleneck opening out therethrough, wherein said carrier is made of a rigid material and is provided with at least two facing longitudinal ribs, said ribs engaging said peripheral side wall of said container for constraining the side wall, the bottom, and the top of the container to fold in a concertina-like fashion.

2. A device according to claim 1, wherein the side wall of the container comprises six faces connected to one another by edges, with two substantially parallel opposite first faces being of greater width than the other faces, the two first faces being of substantially identical width, and the four narrower other faces being of substantially the same, different width and being divided into two pairs each extending between the two first faces, each pair of narrower faces extending via a first outwardly directed enlargement thereof to the top of the container and via a second outwardly directed enlargement thereof to the bottom of the container, the edges and the enlargements being thinner than the other parts of the container and therefore more flexible, such that the ribs of the carrier are capable of causing the narrower faces to fold towards the inside of the container when the container is inserted in the carrier, with the edges acting as hinges.

3. A device according to claim 2, wherein as the substance contained in the container is consumed, the two larger faces move towards each other while remaining substantially parallel, whereas the narrower other faces continue to fold towards the inside of the container tending to become parallel to said larger faces, with the bottom and the top of the container continuing to fold except in the immediate vicinity of the bottleneck where the wider first faces continue to be held a certain distance apart from each other such that substantially all of the substance contained in the container may be dispensed without the walls of the container closing the bottleneck prematurely.

4. A device according to claim 1, further including a dispensing pump and wherein the deformation of the container caused by the ribs when the container is inserted in the carrier raises the pressure of the substance to be dispensed sufficiently to urge said substance into the pump, thereby priming said pump.

5. A device according to claim 1, wherein the carrier includes a bottom and a bottleneck for surrounding the bottleneck of the container, said carrier being separable longitudinally into two halves to enable the container to be placed inside the carrier cover.

6. A device according to claim 5, wherein the two halves of the carrier are fixed to each other by means of lips which overlie one another when the two halves of the carrier are assembled together, said lips being provided with snap-fastening means.

7. A device according to claim 6, wherein the snap-fastening means comprise at least one groove formed in the lip of one of the halves of the carrier, and at least one complementary rib formed on the lip of the other half of the carrier.

8. A device according to claim 5, wherein the bottom of the carrier is connected via a hinge to each of the halves of said carrier.

9. A method of manufacturing a device according to claim 2, in which container formation includes at least one inflation step of blowing compressed gas into an open-ended hollow preform raised to a temperature high enough for it to be deformable, said preform being disposed in a mold having the shape of the container to be made such that said preform expands until it take up the shape of the mold, wherein the portions of the preform corresponding to the edges and to the enlargements of the final container are those portions that move furthest from their initial positions during the inflation step such that the edges and the swellings are the finished portions of the container and thus the most flexible portions.

* * * * *